US006280352B1

(12) United States Patent
Coffeen et al.

(10) Patent No.: US 6,280,352 B1
(45) Date of Patent: Aug. 28, 2001

(54) APPARATUS AND METHOD FOR PERFORMING TIMED BASKETBALL DRILLS

(75) Inventors: Dean A. Coffeen, Russell; Kenneth J. Mahoney, Dorrance, both of KS (US)

(73) Assignee: Athletics Project Inc., Russell, KS (US)

( * ) Notice: Subject to any disclaimer, the term of this patent is extended or adjusted under 35 U.S.C. 154(b) by 0 days.

(21) Appl. No.: 09/644,626

(22) Filed: Aug. 23, 2000

(51) Int. Cl.[7] ..... A63B 69/00; A63B 63/08

(52) U.S. Cl. ..... 473/447; 473/433; 473/472; 434/248

(58) Field of Search ..... 473/422, 431, 473/432, 433, 434, 435, 447, 449, 472, 479, 480; 434/248

(56) References Cited

U.S. PATENT DOCUMENTS

| | | | | |
|---|---|---|---|---|
| 3,427,026 | | 2/1969 | Mahoney | 273/1.5 |
| 3,752,476 | | 8/1973 | Mahoney | 273/1.5 A |
| 3,836,144 | | 9/1974 | Mahoney | 273/1.5 A |
| 4,955,605 | * | 9/1990 | Goldfarb | 473/447 |
| 5,326,094 | * | 7/1994 | Quinn | 473/447 |
| 5,418,547 | * | 5/1995 | Matherne et al. | 340/323 R |
| 5,684,453 | * | 11/1997 | Welch | 473/433 |
| 5,776,018 | * | 7/1998 | Simpson et al. | 473/433 |

* cited by examiner

*Primary Examiner*—Jessica J. Harrison
(74) *Attorney, Agent, or Firm*—William E Hein

(57) ABSTRACT

An apparatus and method for performing timed basketball drills includes one or more ball return units, a basketball goal assembly, a timer/counter, and one or more remote transmitters. The timer/counter senses, processes, stores, and displays the number of balls thrown at and returned from the one or more ball return untis and/or the number of successful shots to the basketball goal assembly. The remote transmitter provides an encoded signal to the timer/counter from either the one or more ball return units or the basketball goal assembly.

8 Claims, 14 Drawing Sheets

OE2 Y1 Y2 Y3 Y4 Y5 Y6 Y7 Y8
OE1 A1 A2 A3 A4 A5 A6 A7 A8
362
360
VCC
358
356
354
Q3 Q2 Q1 Q0
COUT
CIN
U/D
B/D
PE
P3 P2 P1 P0 CLK
148
146
144
102B
102A
102C
0
3
5
VCC

FIG. 3'

| | | |
|---|---|---|
| FIG. 3D | FIG. 3E | FIG. 3F |
| FIG. 3A | FIG. 3B | FIG. 3C |

FIG. 8A
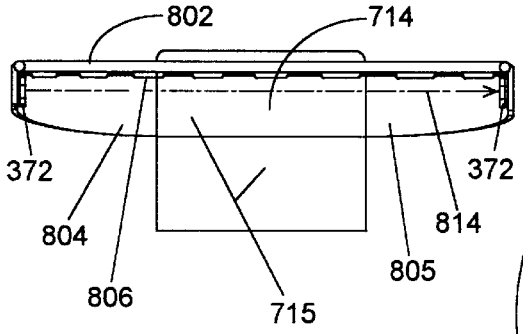
FIG. 8B
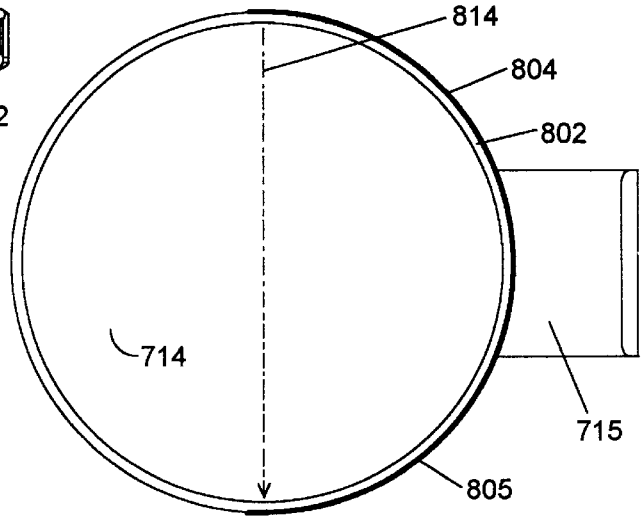
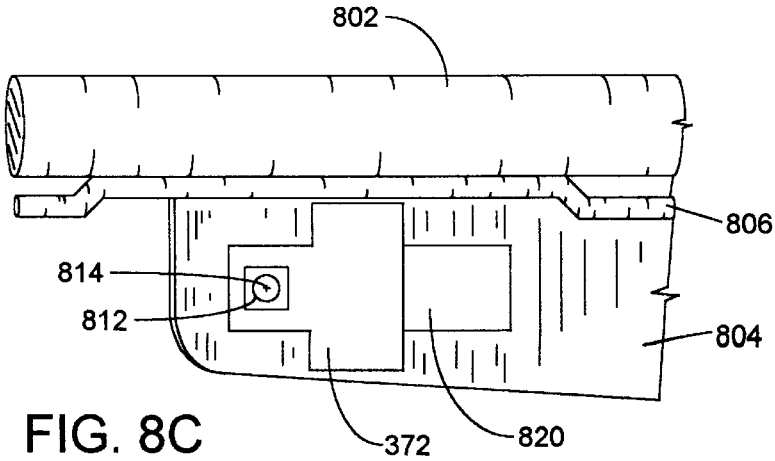
FIG. 8C

APPARATUS AND METHOD FOR PERFORMING TIMED BASKETBALL DRILLS

BACKGROUND AND SUMMARY OF THE INVENTION

This invention relates generally to a projectile return apparatus and, more particularly, to a basketball return apparatus that incorporates electronic means for calculating and displaying time, shooting attempts, shots made, and shooting percentages.

Projectile return apparatuses are well known in the prior art, exemplary of which are U.S. Pat. Nos. 3,427,026, 3,752,475, and 3,836,144. Such apparatuses have proven to be effective tools in the development of athletic skills required in passing, catching, and shooting routines in the game of basketball, for example. Attempts to drill an athlete in a particular workout routine as to the number of completed routines compared to the number of attempted routines over a fixed period of time have often resulted in data for analysis that may be more subjective than objective. When using the projectile return apparatuses of the prior art, it is difficult for the participant to keep track of both the number of attempted shots made and missed with a high degree of accuracy without distracting the participant from the mental and physical process of executing the proper technique involved with a specific drill. The use of another person acting as an observer of these drills may also result in disputed data. The lack of a combined body of standardized data has prevented the establishment of shooting percentage norms in basketball equivalent to hitting averages in baseball and par values in golf, for example.

The present invention provides the athlete and coaching staff greater opportunity to evaluate and develop the athlete's skills by providing a more objective method for measuring standard skills as to time and accuracy of data collection. The collection of this data from numerous standard drills is maintained while preserving the game-like nature of a drill by eliminating non-game-like apparatus such as tethers, rails, netting, floor pad sensors, etc. The present invention allows a body of comparable data to be collected and recorded on an individual athlete over a long time period, facilitating the establishment of norms for many athletes, that are comparable by age, sex, and skill level.

The electronic ball return apparatus of the present invention includes one or more projectile return apparatuses, a basketball goal assembly, a timer/counter, and one or more remote transmitters. The timer/counter functions to sense, process, store, and display the number of balls thrown at and returned from the one or more projectile return apparatuses and/or the number of successful shots to the basketball goal assembly. The remote transmitter provides an encoded signal to the timer/counter from either the one or more projectile return apparatuses or the basketball goal assembly.

The components of the present invention set forth in the preceding paragraph serve to detect and measure such athletic intagibles as strength, accuracy, endurance, desire, etc. that separate highly skilled basketball players from those of lesser skill.

BRIEF DESCRIPTION OF THE DRAWINGS

FIG. 3' is a figure map illustrating the arrangement of FIGS. 3A–F.

FIG. 8A is a pictorial diagram illustrating the rear cross-section of a basketball goal of the type suitable for mounting sensors employed with the remote transmitter of FIG. 5.

FIG. 8B is a top view of the basketball goal of FIG. 8A.

FIG. 8C is a detailed diagram illustrating the way in which the sensors employed with the remote transmitter of FIG. 5 may be mounted on the basketball goal of FIGS. 8A–B.

DETAILED DESCRIPTION OF THE PREFERRED EMBODIMENTS

Figures 1A, 1B, 1C:
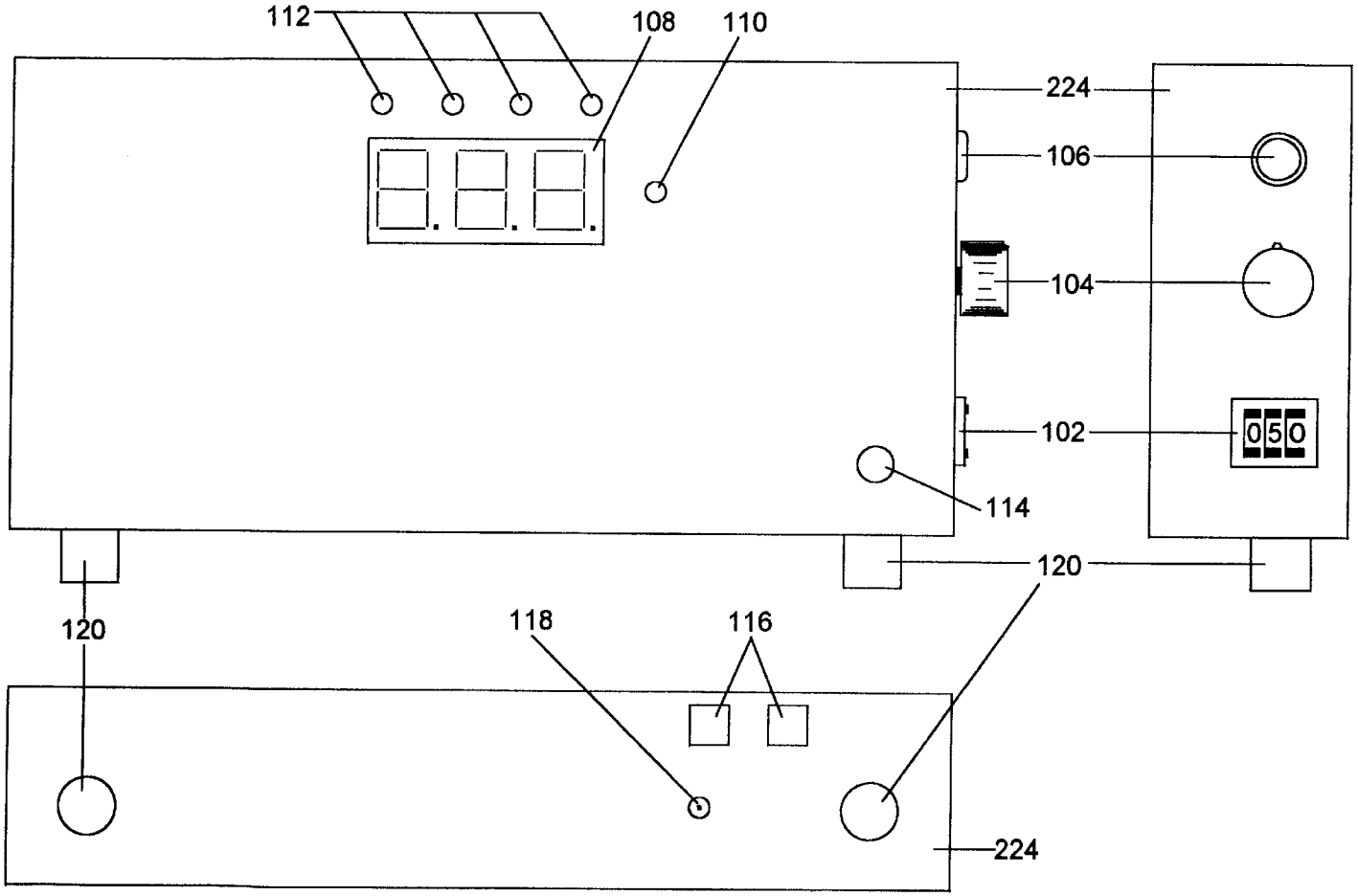
FIGS. 1A–C are front, side, and bottom views, respectively, of the timer/counter employed in the electronic ball return apparatus of the present invention.

Referring now to FIG. 1, there are shown front, side, and bottom views of a timer/counter 224 of the present invention having mounted thereon a timer switch 102 for presetting a countdown timer, a multiposition rotary switch 104 for selecting OFF, ON-CONTINUOUS, or ON-RUN-STOP modes of operation, a RESET switch 106, a 3-digit multifunction LED display 108, an optional low voltage indicator 110, a series of optional indicator LEDs for indicating the sequence of display operations, a speaker aperture 114, a pair of electrical connector jacks 116, an antenna 118, and shock mounts 120.

Figure 2:
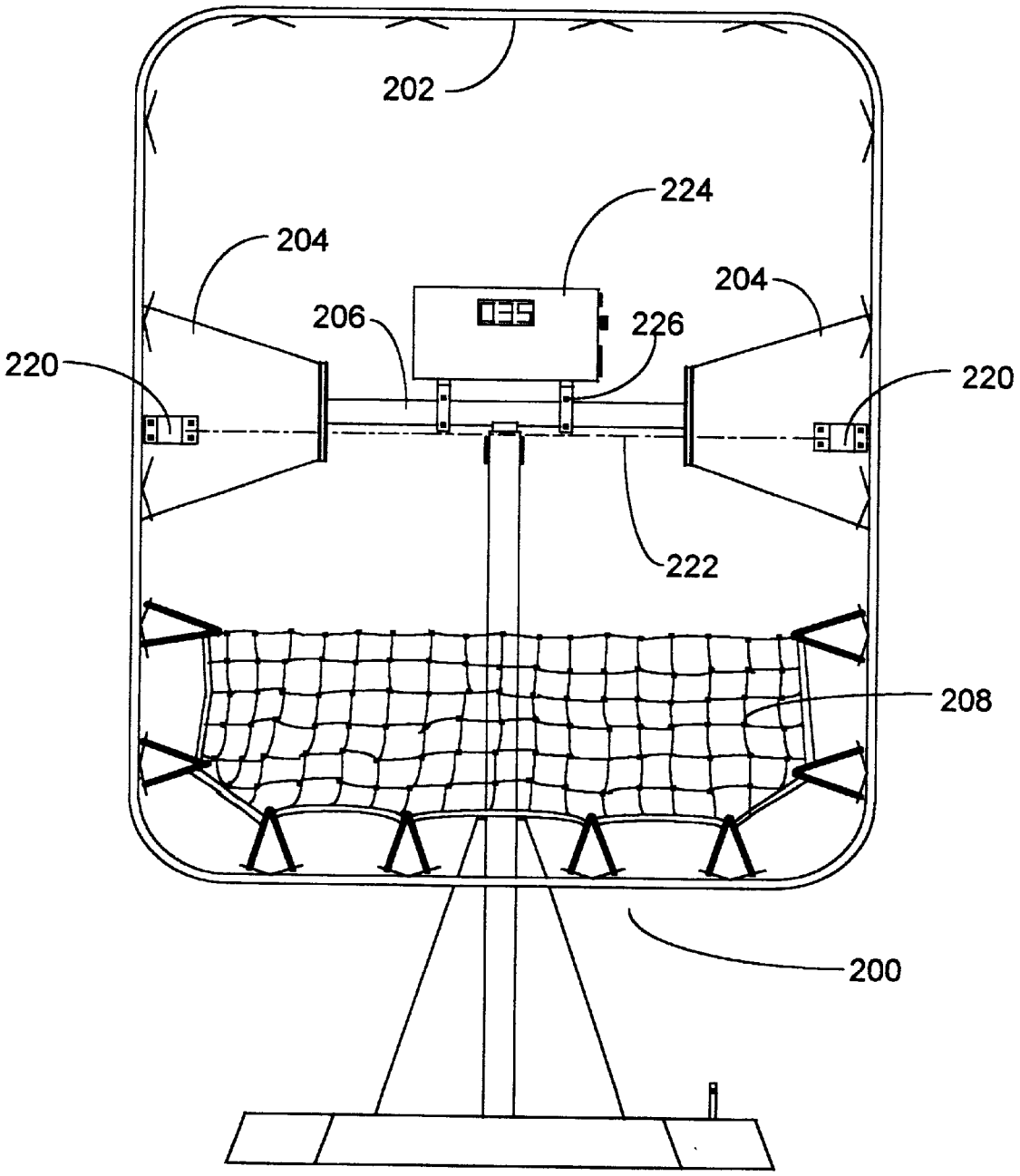
FIG. 2 is a pictorial diagram of a ball return unit employed in the electronic ball return apparatus of the present invention.

Referring now to FIG. 2, there is shown a ball return unit 200 of the type known in the art having a panel support assembly 202, left and right side braces 204, a horizontal support shaft 206, and a return panel assembly 208 of netting. Return panel assembly 208 covers the entire area defined by panel support assembly 202, even though only a portion of it is illustrated. A pair of light sensors 372 are mounted by way of brackets 220 on the left and right side braces 204 of the panel support assembly 202 such that they are optically aligned along an axis 222 that preferably lies approximately 3.8 to 6.35 centimeters behind return panel assembly 208. Timer/counter 224 is mounted on support shaft 206 using conventional hardware and clamps 226.

Figure 3A:
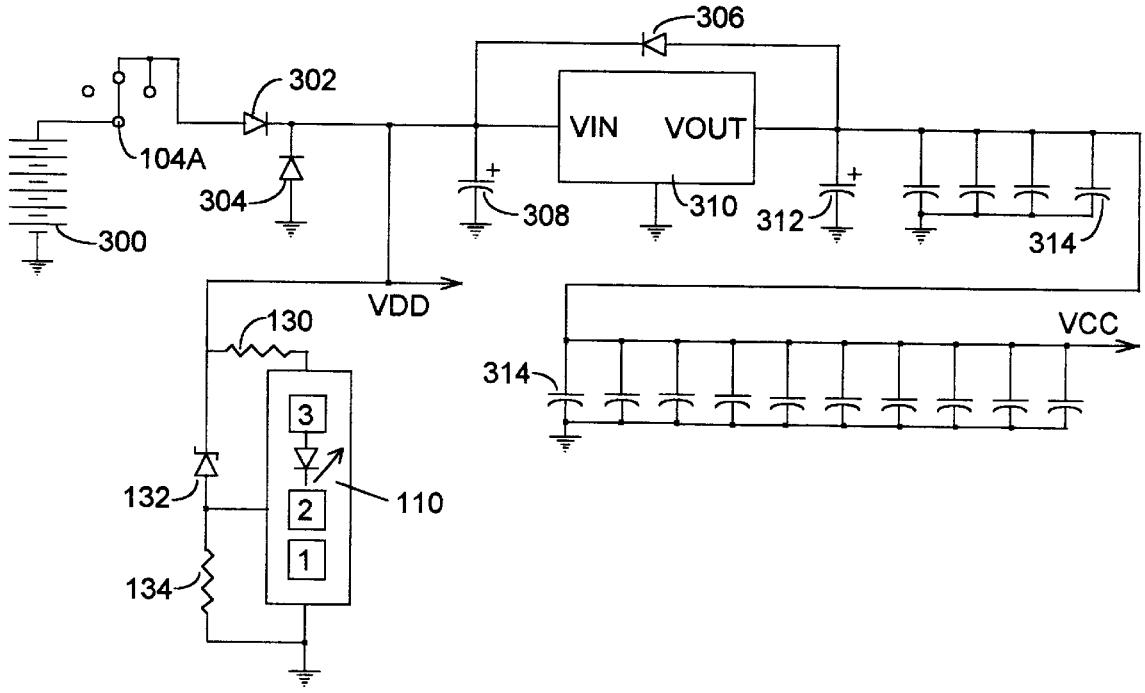
FIGS. 3A–F are detailed schematic diagrams of the circuitry employed in the timer/counter of FIGS. 1A–C.
Figure 3B:
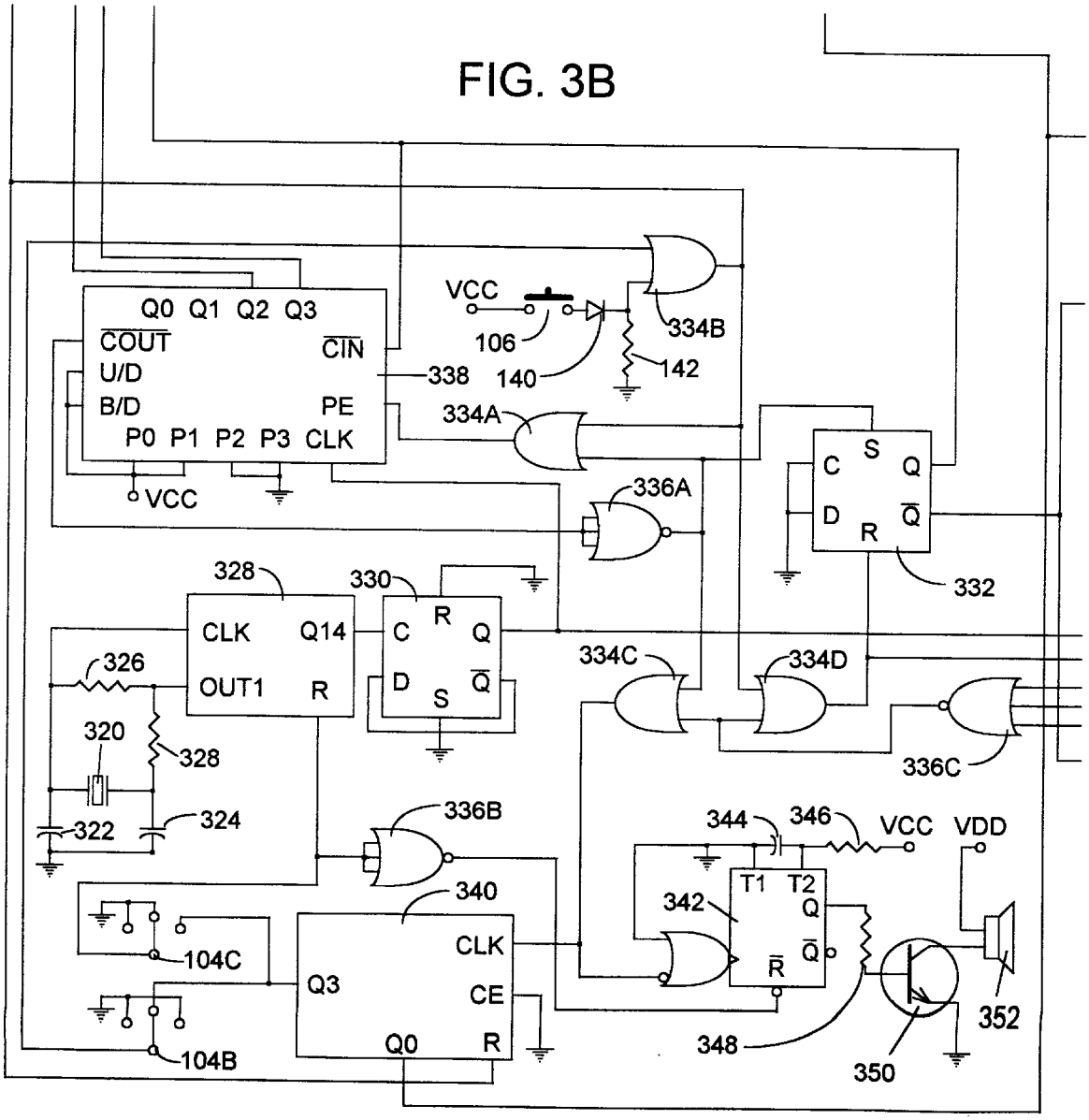
Figure 3C:
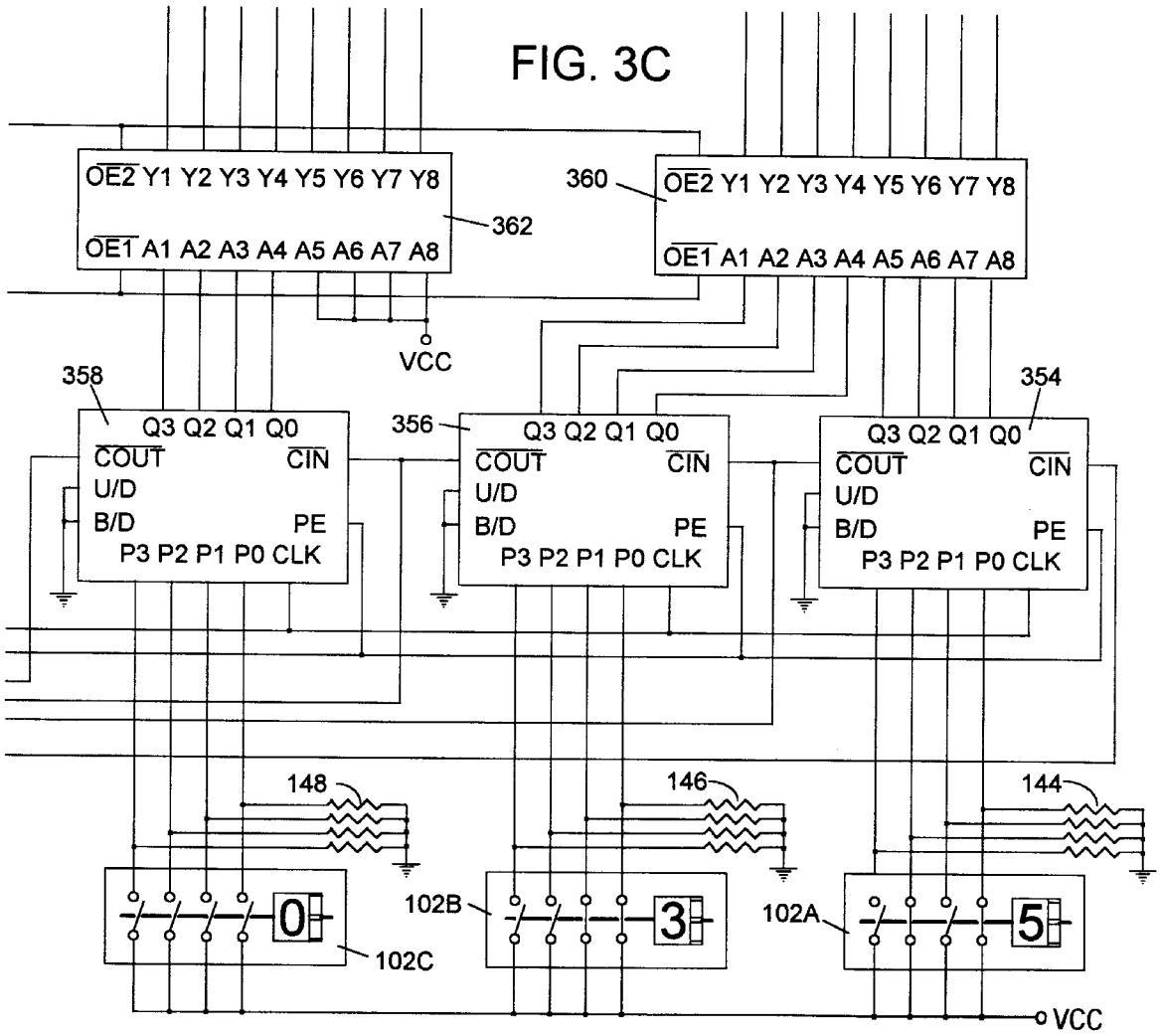
Figure 3D:
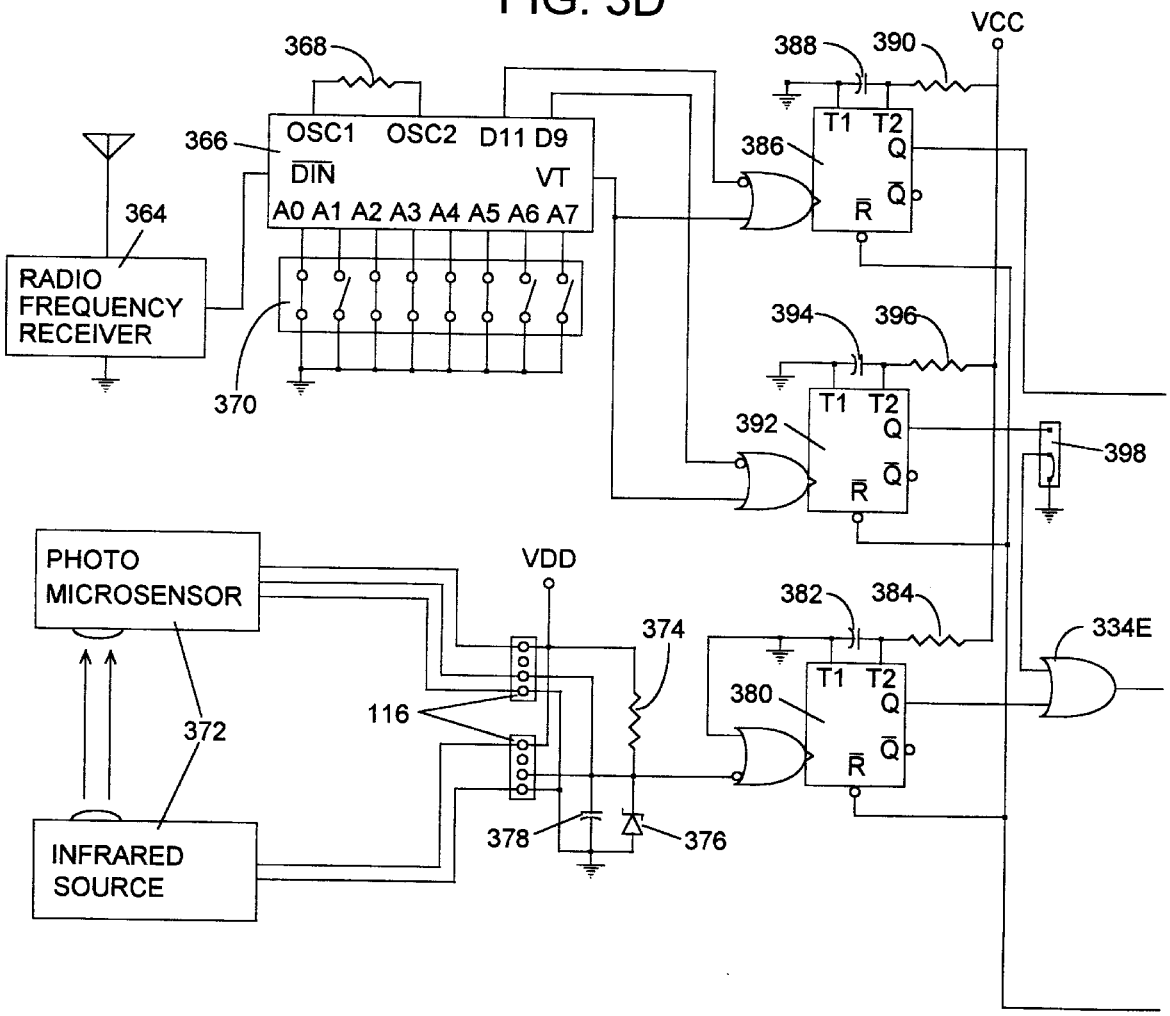
Figure 3E:
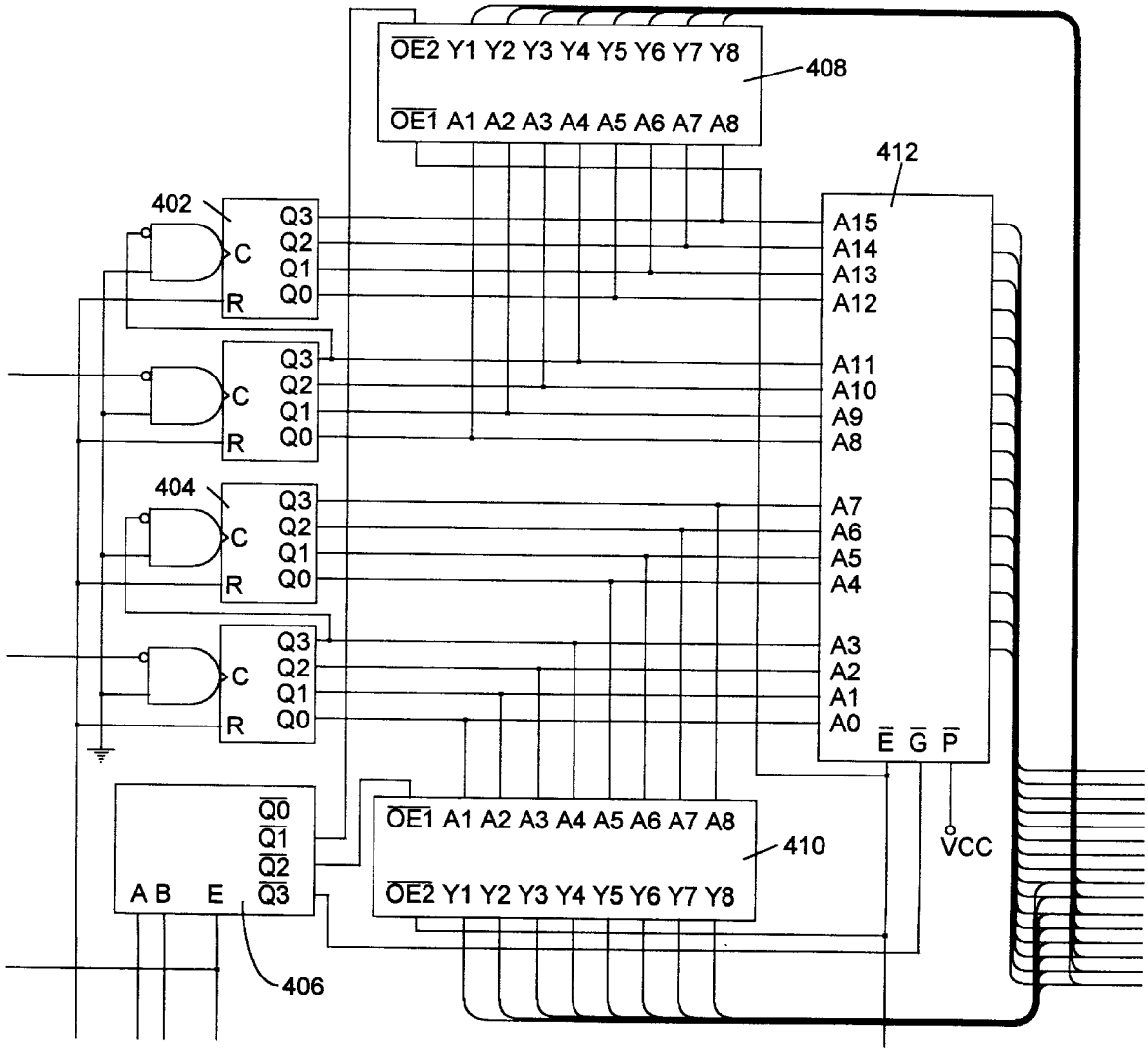
Figure 3F:
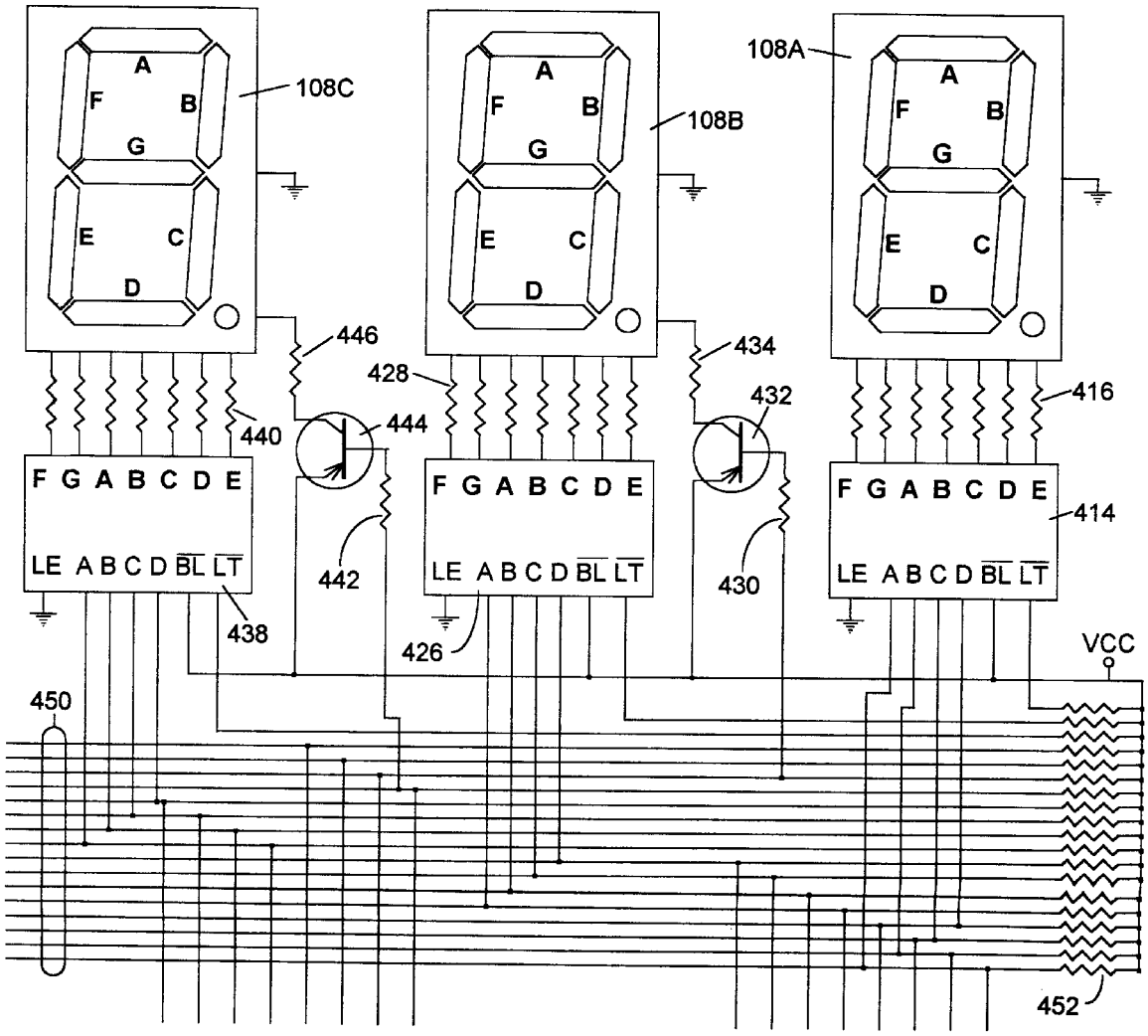

Referring now to FIG. 3A, there is shown a power supply including a D.C. source 300 controlled by OFF/ON/ON switch 104A. A pair of rectifier diodes 302, 304, provide circuit and battery protection. Each of the diodes 302, 304 may comprise a commercially available 1N4002 diode, for example. Diode 306 serves to protect a voltage regulation integrated circuit 310, which may comprise a commerically available LM7805 integrated circuit. A pair of 1000 uf. electrolytic capacitors 308, 312 serve to filter the power supply at low frequency. Capacitors 314, each of which has a capacitance in the range of 0.01–0.1 uf., serve to filter high frequencies generated by the switching of the digital integrated circuits within the circuitry of FIGS. 3B–F. Each of the capacitors 314 is connected at or near the supply pin of each one of those integrated circuits. A Lumex SSL-LX5099LBI-SRD 110, together with resistors 130, 134, and a zener diode 132, form an optional low battery voltage indicator circuit.

Referring now to the circuitry of FIGS. 3B–F, a crystal oscillator timebase circuit, which may comprise integrated circuits 328, 330, a crystal 320, resistors 326, 328, and capacitors 322, 324, is operated at 32,768 Hz and followed by a 15-stage binary counter to produce pulses of 1 Hz. This system clock is used by a display control integrated circuit 338 and presetable timer integrated circuits 354, 356, 358, all of which may comprise MC14029 integrated circuits. Integrated circuit 334, which may comprise an MC14071B integrated circuit, configured as OR gates, and integrated circuit 336, which may comprise an MC14025B integrated circuit, configured as NOR gates, form a steering network to provide control signals to and from display control integrated circuit 338, presetable time integrated circuits 332, 340, 354, 356, 358, and components 106, 140, 142 that form a reset circuit. An integrated circuit 332, which may comprise one-half of a commercially available MC14013B integrated circuit, is employed as an RS flip-flop which toggles between display and timer modes. Integrated circuit 340, which may comprise an MC14017B integrated circuit, serves as a sequence counter to count the number of CARRY pules that have been generated by the display control counter and the presetable timer for the purpose of issuing control signals through switch 104 for reset operations or for disabling the timebase clock. It is the basic function of the steering network to provide control signals to the various counters while selectively sounding an alert tone. Integrated circuit 342, which may comprise one-half of an MC14538B integrated circuit, together with a capacitor 344, a resistor 346, a bias resitor 348, and an NPN driver transistor 350, which may comprise a 2N2222A transistor, form a timing circuit that function to trigger and control the length of time that an audible alert device 352 sounds.

Switch 102, along with pulldown resistors 144, 146, 148, provide the necessary logic levels for the presetable timer integrated circuits 354, 356, and 358. Display of the presetable timer is effected by applying controlling signals to a pair of optical 3-state line drivers 360, 362, each of which may comprise a commercially available MC74H541A integrated circuit. The collection of raw data is performed through two inputs, one of which is a remote transmitter, described hereinbelow, through a radio frequency receiver 364, which may comprise a Ming Microsystems RE-99V3 receiver module, the output of which is applied to the input of a digital remote control decoder integrated circuit 366, which may comprise a Holtek HT12F integrated circuit. An 8-position DIP switch 370 permits the address of the digital remote control decoder 366 to be easily changed, if necessary. Signals from the decoder data lines and VT line are applied to a monostable multivibrator 386, which may comprise an MC14538B integrated circuit, and which is used to supply uniform pulses to the counters that follow. The second input, from sensors 372, which may comprise Omron photo microsensors EE-SPW311, is made through a plug/jack 116 so as to supply the sensors 372 with voltage and ground connections. A load resistor 374, a zener diode 376, and a capacitor 378 collectively serve to condition the pulse to the logic level of the input of integrated circuit 380, which is a monostable multivibrator used in the same fashion as integrated circuit 386. Timing circuit resistors 384, 390, 396 are each preferably 240K ohms, and capacitors 382, 388, 394 are each preferably 1 uf. Signals from the monostable multivibrators 380, 386 are applied to the inputs of counters 402, 404, which may comprise MC1451B or MC14520B integrated circuits, configured as two 8-bit up counters A and B. The outputs of these two counters are used directly by the logic unit or are passed to the display bus.

The logic unit may be the combination of integrated circuit 412, which may comprise an Am27C1024 integrated circuit, and integrated circuits 408, 410, each of which is a 3-state buffer that may comprise an MC74HC541A integrated circuit. A decoder/demultiplexer integrated circuit 406, which may comprise an MC74HC139A integrated circuit, and the display control counter integrated circuit 338, serve to apply control signals to the logic unit for the display mode order and timing of events. The logic unit integrated circuit 412, may contain preprogrammed algorithms, suitable for displaying information from either counter or a mathematical relationship between the two counters, such as a simple look-up table of percentages, in read-only memory. By using 3-state buffers with high impedance output, signals from the control circuit are unsed to alternately select three digits of display information from any of the logic unit integrated circuits 408, 410, 412 or a two or three-digit presetable timer display of 99 to 0 seconds or 999 to 0 seconds. Typically, in this application, the algorithms preprogrammed in the logic unit allow for three digits of display information and non-displayed control information, for a total of sixteen data lines.

The outputs of the logic unit and the presetable timer are OR-gated to the input of the display bus 450, which is terminated in a plurality of resistors 452, whose typical values may be 10K to 100K ohms. Three BCD-to-seven segment latch/decoder/driver integrated circuits 414, 426, 438, each of which may comprise MC14511B integrated circuits, are employed to represent units, tens, and hundreds digits in the display 108. A plurality of current limiting resistors 416, 428, 440 of 100 to 150 ohms serve to set the desired brightness level of display 108. Decimal point LEDs and similar individual LEDs may be driven by a bipolar logic transistor and an appropriate limiting resistor, in accordance with known design techniques.

Figure 4:
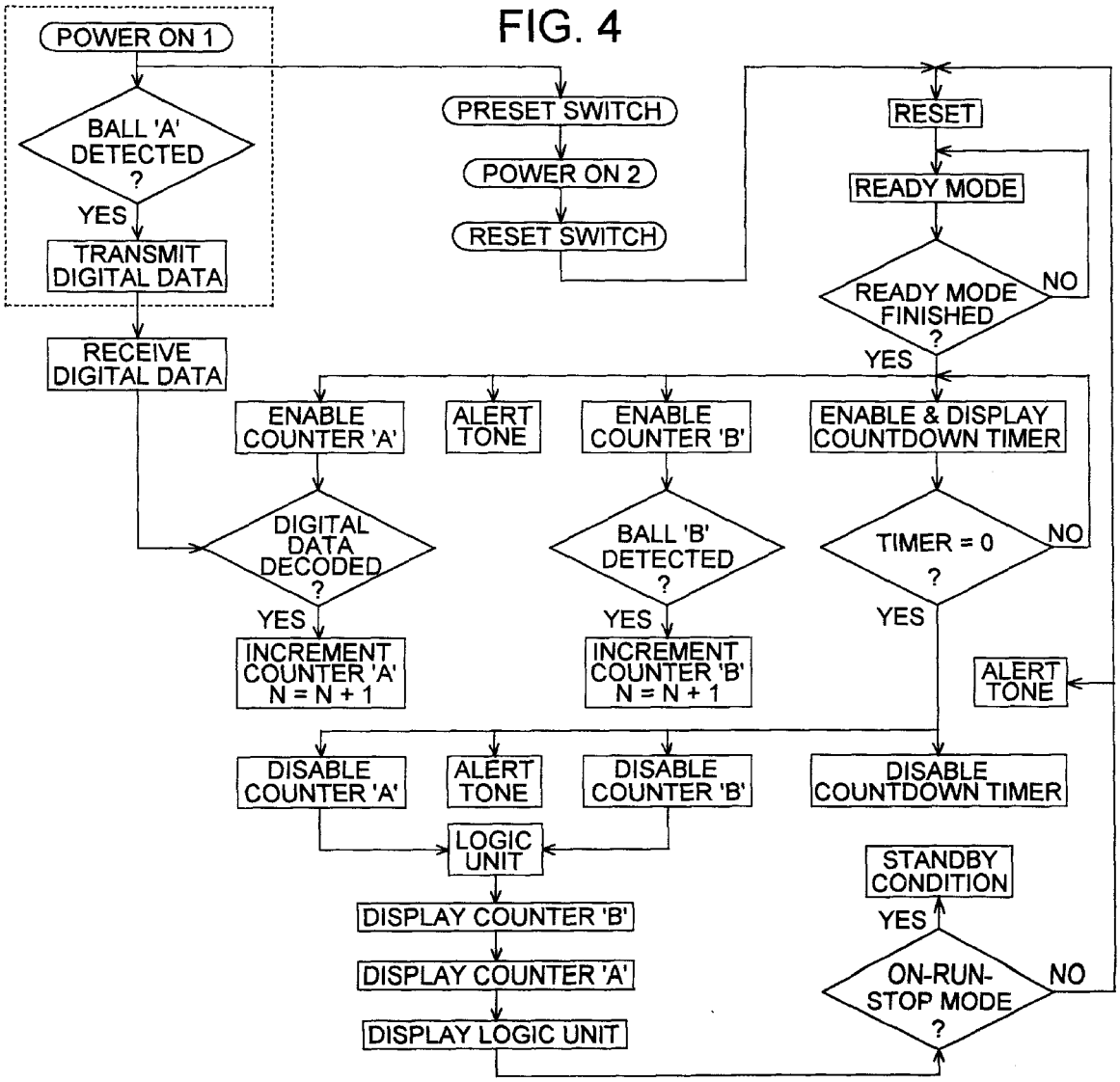
FIG. 4 is a flow chart illustrating the logic blocks executed by both the remote transmitter of FIG. 5 and the timer/counter of FIGS. 1A–C during ON-CONTINUOUS and ON-RUN-STOP operation.
Figure 5:
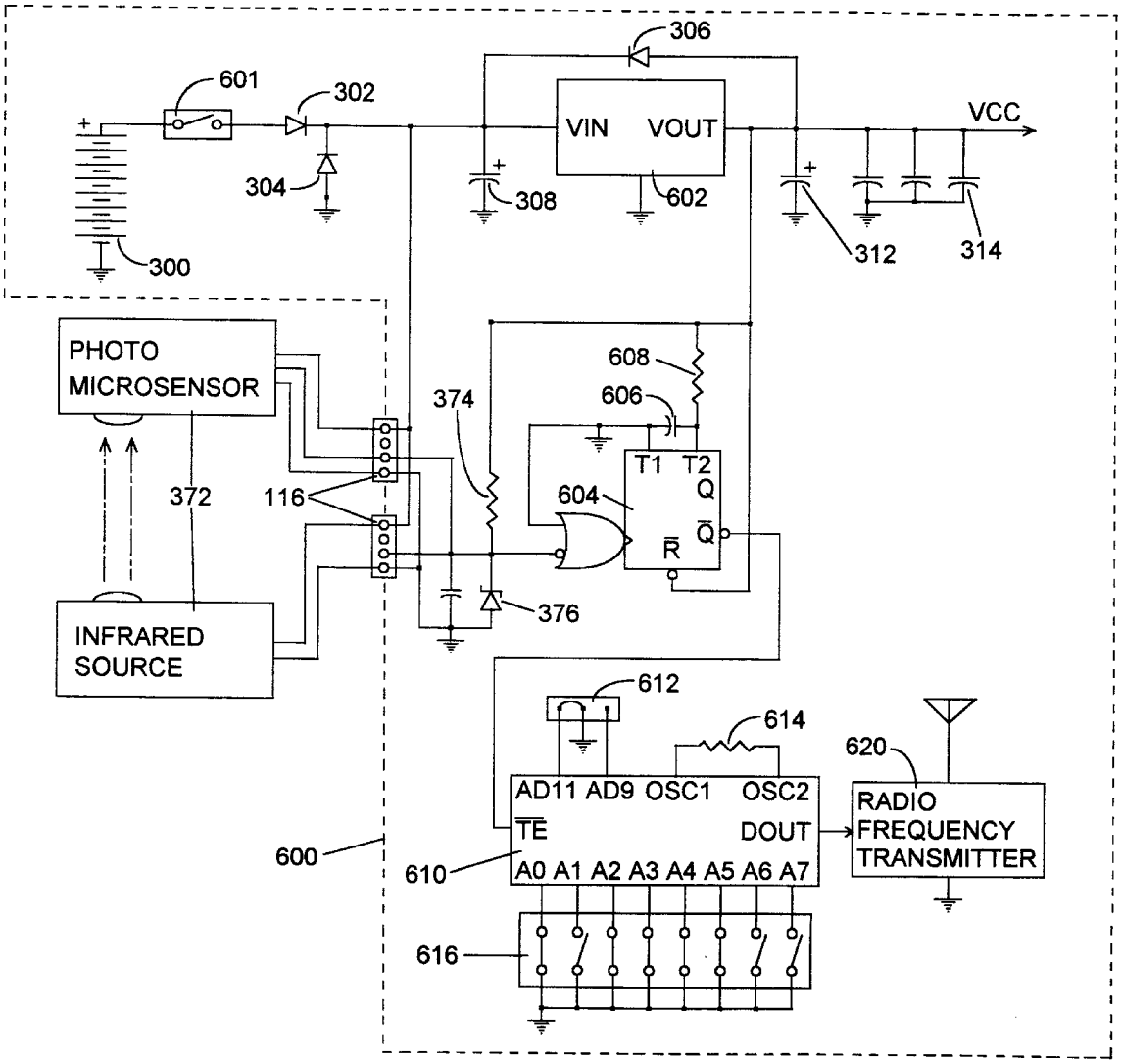
FIG. 5 is a detailed schematic diagram of a remote transmitter that may be employed with the timer/counter of FIGS. 1A–C.
Figure 6:
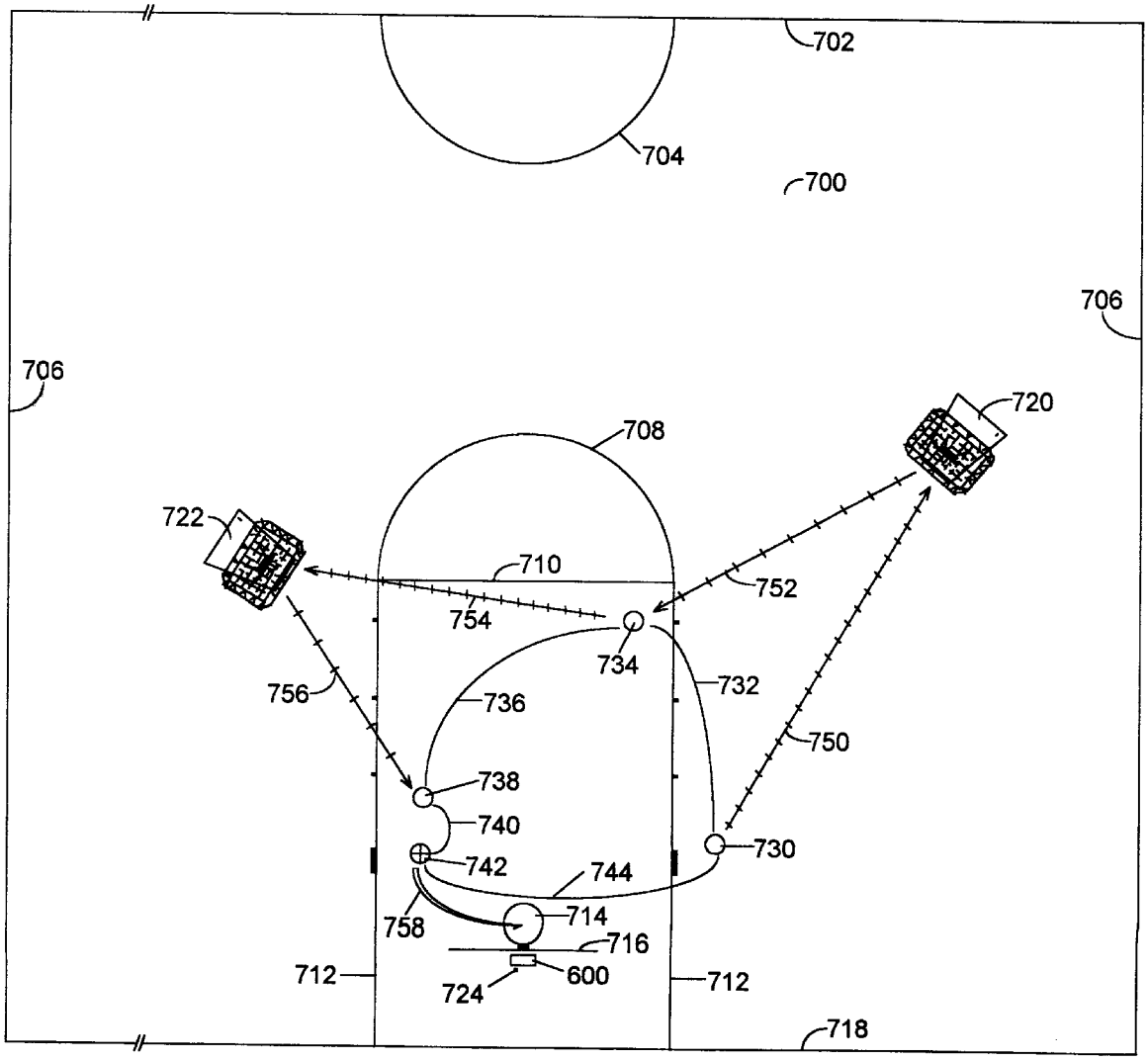
FIG. 6 is a pictorial diagram illustrating a basketball drill that may be performed using two of the ball return units of the present invention.

Referring now to FIG. 4, there is shown a flow chart of the operations performed by the timer/counter 224 mounted on the ball return unit 200 of FIG. 2 and the remote transmitter of FIG. 5 mounted on the goal 714 of FIG. 6. With the ball return unit 200 in position on a basketball court in preparation for a desired drill, the OFF/ON switch 601 of the remote transmitter is turned on. This allows the sensors of the remote transmitter, enclosed within dashed lines in FIG. 4, to detect BALL A passing through the goal 714, encode a predetermined digital signal for each BALL A passing through the goal 714, and transmit that digital signal by the use of a suitable low power radio frequency transmitter 620. Turning on the remote transmitter first ensures that no spurious signals are received by the timer/counter 224.

The setting of the PRESET SWITCH of timer/counter 224 is immediately confirmed, the POWER ON 2 switch is set to the ON position, and the RESET SWITCH is activated because the timer/counter may otherwise start in a random position. Following the RESET operation, the timer/counter 224 enters a READY MODE, which allows the player to move from the ball return apparatus to the starting position on the court. When the READY MODE is completed, COUNTERS A and B are enabled, an ALERT TONE is sounded for 0.5 to 3 seconds, and the COUNTDOWN TIMER is enabled and displayed. The player may then start the prescribed drill, passing the ball to the ball return apparatus 722 where a BALL B is detected and COUNTER B is incremented N=N+1, retrieving the ball and shooting a goal, which causes BALL A to be detected, thereby activating the remote transmitter. A matched radio receiver in the timer/counter 224 is used to DETECT DIGITAL DATA. If the DIGITAL DATA DECODED is correctly matched, the resulting pulse causes COUNTER A to be incremented to N=N+1.

When the COUNTDOWN TIMER reaches zero, its display is terminated, the audio ALERT TONE sounds as before, and the COUNTERS A and B are disabled. The timer/counter 224 then enters a display mode so that the data stored in COUNTER A, COUNTER B, and the LOGIC UNIT are displayed in sequence. At the end of the display mode, the timer/counter ON state is tested to determine if it is operating in the ON-CONTINUOUS MODE or the ON-RUN-STOP MODE. If timer/counter 224 is in the ON-RUN-STOP MODE, it will enter a STANDBY CONDITION by disabling the timebase clock. If, however, the timer/counter 224 is in the ON-CONTINUOUS MODE, an ALERT TONE is sounded, the RESET operations are performed, and the operations again loop to the READY MODE.

Referring now to FIG. 5, there is shown a remote transmitter 600 that is employed in the electronic ball return apparatus of the present invention. A power supply similar to that shown in FIG. 3A is employed to power remote transmitter 600, except that an SPST on/off switch 601 and a smaller voltage regulator 602, which may comprise an LM78L05 integrated circuit, may be used. The infrared photo-microsensor circuits used for input are the same as described above in connection with the timer/counter 244. One-half of a monostable multivibrator 604, which may comprise an MC14538B integrated circuit, a capacitor 606, and a resistor 608, are used in the same fashion as components 342, 382, 384 in the counter/timer circuit of FIGS. 3A–F, except that the reset of multivibrator 604 is fixed (logic high) rather than switched. A trigger signal is passed to a digital encoder integrated circuit 610, which may comprise a Holtek HT12E integrated circuit. A jumper 612 and DIP switch 616 are used to address digital encoder 610, and an oscillator resistor 614 sets the frequency of oscillation. The digital output of digital encoder 610 is then used to modulate a radio frequency transmitter 620, which may comprise a Ming Microsystems TX99V33 transmitter module.

Referring now to FIG. 6, there is shown a pictorial diagram of a portion of a basketball court 700 having boundaries 702, 704, 706, 718 on which the electronic ball return apparatus of the present invention may be employed to carry out various drills. A first ball return unit 720 with timer/counter 224 mounted thereon is positioned outside and behind the free throw line 710, as illustrated. A second ball return unit 722 is also positioned on the opposite side of the free throw line 710, extended as shown. The remote transmitter 600 of FIG. 5 is mounted behind the goal 714 and backboard 716.

Figure 7:
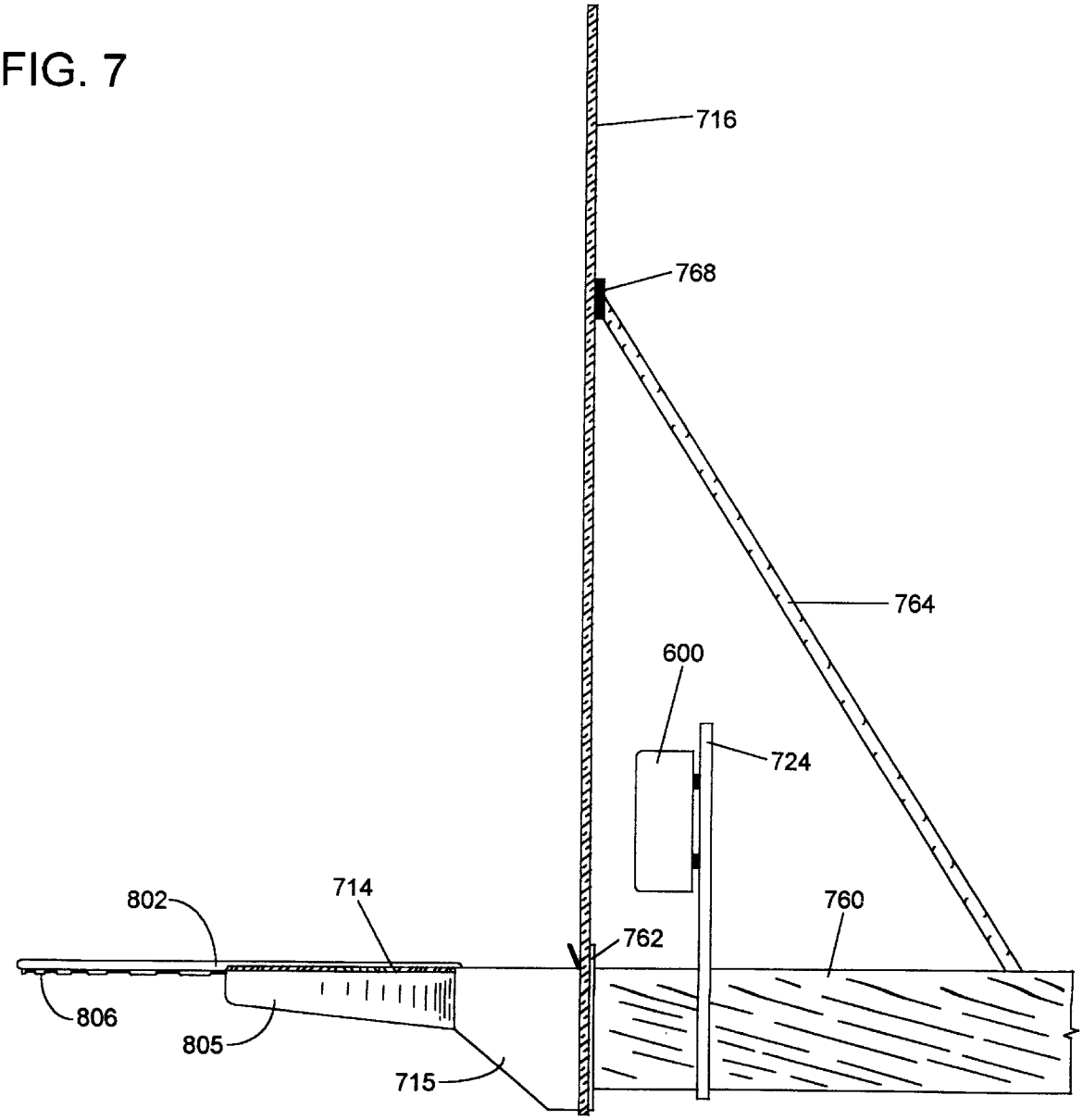
FIG. 7 is a pictorial diagram illustrating the way in which a basketball goal assembly and the remote transmitter unit of FIG. 6 may be mounted on a backboard support.

Referring now to FIG. 7, there is shown a side view of a basketball goal assembly 714, which may comprise a circular goal rim 802 with net attachments 806, a right rim side brace 806, and a box 715 having seven sides. The rear side of box 715 serves as a rim attachment plate which is used to secure the basketball goal assembly 714 to a glass backboard 716 and to a backboard support boom 760 in the usual fashion. The backboard 716 is secured to the support boom 760 by attachment plate 762 and a pair of backboard braces 764, each being secured at one end to an upper corner of the backboard 716 by the backboard brace attachments 768 (one of each being shown) and secured at the other end to the backboard support boom 760. The remote transmitter unit 600 is shown attached to mounting bracket 724 which is semi-permanently secured to the backboard support boom 760 so that it can be moved back and forth along the boom 760. The remote transmitter unit 600 may be mounted to allow movement upward or downward along the mounting bracket 724 relative to the position of the basketball goal assembly 714.

Referring now to FIG. 8A, there is show a rear cross section of the basketball goal assembly 714 showing the rim 802 with net attachments 806, the left and right rim side braces 804, 805, and two sides of the box 715. The sensors 372 are shown in position under the rim 802 mounted on the rim side braces 804, 805. The optical axis of the sensors 372 is represented by the dashed arrow 814 across the goal 714.

Referring now to FIG. 8B, there is shown a top view of the basketball goal assembly 714 with the rim 802 attached to the side braces 804, 805 and to the box 715, as indicated by the heavy lines on the outside of the rim 802. The optical axis of the sensors 372 (not shown) is represented by the dashed arrow 814 across the basketball goal assembly 714.

Referring now to FIG. 8C, there is shown a section of a basketball goal rim 802, along with the tip of the left side brace 804 and a portion of the net attachments 806. This style of basketball goal has been selected because the side braces 804 are mounted to the outside underside of the rim 802 so that the sensors 372 can be mounted under the rim 802 where there is less possibility that they will interfere with or come in contact with a basketball or a player. The side braces 804 should extend far enough forward so that they permit the optical axis 814 of the sensors to pass across the center of the basketball goal 802 plus a short distance to provide physical protection for the sensors 372. The height of the side braces 804 at the tip should be 7.6 millimeters greater than the width of the sensors 372 for physical protection. Care should be taken to mount the basketball goal net attachments 806 so that normal movement of the net does not activate the sensors 372. Should net bounce be a problem, a treated net may be used. Sensors 372 include a window/lens 812 and a wiring connector 820.

Both the timer/counter unit 224 and the remote transmitter 600 of the present invention are preferably powered from battery sources. While both units could be powered from commercial power lines, the use of batteries eliminates the hazards of having a drop cord on or near the basketball court. Because battery life is limited in such an arrangement, a minimal display of three digits with related indicators was chosen for the timer/counter unit 224. The height of the digits is such that they can be read from normal playing distances. This allows the use of the electronic ball return apparatus at any location within the area of the basketball court.

Basketball is a time-oriented game with periods of intense physical activity followed by short periods of semi-activity. One of the purposes of the timer/counter unit 224 is to simulate these time intervals. A ready mode allows the player to move from resetting the timer/counter unit 224, which may also allow time for coaching instruction. In a timer mode, which is a period of intense athletic activity during which time is counted down on the display 108, data is collected in parallel from the sensors 372 to be input into counters A and B. In the subsequent display mode, the contents of the counters A and B and the resulting output of the processed logic unit, which may represent the percentage of counter A contents to counter B contents, are sequenced serially, each for a period of four seconds. The emphasis is then shifted from a score oriented exercise to a time oriented exercise. Running scores and shooting percentages may be of interest, but only the final results of each exercise are truely important. Coupling the counters A and B to the timer has resulted in a training tool which is more accurate than the rate approximation of prior art basketball throwing machines or even manually-operated stopwatches.

While the beginning of a basketball drill may be signalled to a counter by any of several prior art methods, the electronic ball return apparatus of the present invention allows an athlete to simulate the passing and catching of a basketball in real time at the beginning of each drill. The sensors 372 and timer/counter unit 224 are mounted on the frame of the ball return unit 200 so that it is self-contained, occupying no more space on the court than any prior art ball return apparatus. The ball return apparatus of the present invention eliminates the need for prior art floor mat switches, hand switches, signal lines, electrical power cords, laser beam devices, computer carts, scoreboards, etc. that clutter the court. While it is possible to employ one of the ball return units 200 under the backboard to return shots made toward or through the basketball goal, it is generally placed outside the keyhole, thus allowing the athlete to dribble toward the goal, pass the basketball to the ball return unit 200, recover the returned basketball, shoot toward the goal, and rebound the ball in various game-like exercises. This is in contrast to prior art basketball training apparatuses which may limit the skill training of players to simply shooting, while restricting access to the area under the goal by the physical presence of a ball return apparatus and/or netting. The apparatus of the present invention emphasizes maintaining a game-like setting in which the athlete practices passing, cathching, and receiving the basketball, all of which are game-like moves.

Referring once again to FIG. 6, a typical basketball drill known as the Postman Flare Pass and Roll to the Basket drill is begun by the postman, at the first tone alert issued by the timer/counter unit 224, from a rebound position 730, by passing the ball to the ball return unit 720. The postman continues his movement along the path 732 to position 734 where he receives the ball returned along the path 752 from the net of the ball return unit 720. The ball is then fanned with an overhead pass along the path 754 to a second ball return apparatus 722 at the free throw line 710 extended to the opposite side of the key, defined by lines 708 and 712, facing toward the goal 714 with the net in the raised position. The postman quickly moves along the path 736 to the position 738 where he receives the basketball returned along the path 756 from the ball return unit 722. He then reacts by rolling with a reverse pivot or front turn in the area of path 740 to the position 742 from which he shoots the basketball along path 758 toward the goal 714. The postman then recovers the ball in the area along path 744 and returns to position 730 to repeat the drill until the second tone alert issued by timer/counter 224 signals the end of the drill, at which time the displayed results may be observed for possible record keeping.

We claim:

1. Apparatus for use by athletes in performing basketball drills, the apparatus comprising:

a ball return unit adapted for placement in a desired position on the floor of a basketball court, the ball return unit having a frame and having an elastic member supported by the frame for returning a basketball thrown at the ball return unit;

one or more sensors mounted on the ball return unit for detecting a basketball striking the ball return unit;

a timer/counter mounted on the ball return unit;

a transmitter mounted proximate a basketball goal on the basketball court, said transmitter communicating with said timer/counter;

one or more sensors mounted proximate the basketball goal for communication with the transmitter, said plurality of sensors being operative for detecting successful basketball goals;

said timer/counter being operative for initiating a timed cycle for separately accumulating attempted basketball goals, as detected by said one or more sensors mounted on the ball return unit, and successful basketball goals, as detected by said one or more sensors mounted proximate the basketball goal, during said timed cycle, for processing a computed percentage of accumulated successful basketball goals to accumulated attempted basketball goals, and for thereafter visually displaying the accumulated attempted and successful basketball goals and the processed computed percentage of successful basketball goals to attempted basketball goals.

2. Apparatus as in claim 1, wherein said timer/counter is further operative for sounding an audible alert tone at the beginning and end of said timed cycle.

3. Apparatus as in claim 1, wherein said timer/counter is selectively manually resettable at the end of said timed cycle.

4. Apparatus as in claim 1, wherein said timer/counter is selectively operative for automatically initiating a timed cycle at the end of each previous timed cycle.

5. Apparatus as in claim 1, wherein said elastic member of said ball return unit comprises a net positioned within said frame, the net having a peripheral edge that is elastically connected to said frame.

6. Apparatus as in claim 1, further comprising:

an additional ball return unit adapted for placement in a second position on the floor of the basketball court, said additional ball return unit having a frame and having an elastic member supported by the frame for returning a basketball thrown at said additional ball return unit, said additional ball return unit having a frame and having an elastic member supported by the frame for returning a basketball thrown at the additional ball return unit, said additional ball return unit having one or more sensors mounted thereon for detecting a basketball striking said additional ball return unit; and a transmitter mounted on said ball return unit, said transmitter communicating with said one or more sensors mounted on said additional ball return unit and with said timer/counter.

7. A method for enabling an athlete to perform basketball drills, the method comprising:

providing a ball return unit at a desired position on the floor of a basketball court, the ball return unit being operative for detecting and returning a basketball thrown thereto by the athlete;

providing a timer/counter on the ball return unit;

initiating a timed drill cycle;

accumulating basketball goals attempted by the athlete during said timed drill cycle, as detected by said ball return unit;

accumulating those basketball goals attempted by the athlete which successfully pass through a basketball goal on the basketball court during said timed drill cycle;

processing a computed percentage of accumulated successful basketball goals to accumulated attempted basketball goals during the timed drill cycle; and visually displaying, at the end of the timed drill cycle, the accumulated attempted basketball goals, the accumulated successful basketball goals, and the percentage of accumulated successful basketball goals to accumulated attempted basketball goals.

8. A method as in claim 7, further comprising the step of sounding an audible alert tone at the beginning and end of said timed drill cycle.

* * * * *